US006191533B1

(12) United States Patent
Kim et al.

(10) Patent No.: US 6,191,533 B1
(45) Date of Patent: Feb. 20, 2001

(54) APPARATUS FOR DISCHARGING PLASMA DISPLAY PANEL WITH TIME-LAG AND METHOD THEREOF

(75) Inventors: Yeong-Jae Kim, Suwon; Hak-Yong Kim, Seoul, both of (KR)

(73) Assignee: Samsung Electronics Co., Ltd. (KR)

( * ) Notice: Under 35 U.S.C. 154(b), the term of this patent shall be extended for 0 days.

(21) Appl. No.: 09/382,332

(22) Filed: Aug. 25, 1999

(30) Foreign Application Priority Data

Aug. 25, 1998 (KR) ..... 98-34401

(51) Int. Cl.[7] ..... G09G 3/10
(52) U.S. Cl. ..... 315/169; 345/55; 345/103
(58) Field of Search ..... 315/169.1, 169.2, 315/169.3, 169.4, 364, 365, 366, 368.15, 368.17, 368.16, 368.11, 368.12, 368.13, 368.19–368.28; 345/55, 56, 57, 103, 213

(56) References Cited

U.S. PATENT DOCUMENTS 5,534,892 * 7/1996 Tagawa ..... 345/173
5,617,113 * 4/1997 Prince ..... 345/103
5,844,538 * 12/1998 Shiraki et al. ..... 345/98
5,886,677 * 3/1999 Woo ..... 345/13
5,907,314 * 5/1999 Negishi et al. ..... 345/103

FOREIGN PATENT DOCUMENTS 8-106854 4/1996 (JP) ..... H01J/17/49

* cited by examiner

*Primary Examiner*—Don Wong
*Assistant Examiner*—Trinh Vo Dinh
(74) *Attorney, Agent, or Firm*—Dilworth & Barrese, LLP

(57) ABSTRACT

A plasma display panel (PDP), and more particularly, an apparatus for discharging the PDP with a time-lag by a horizontal line, thus reducing instantaneous power consumption, and a method thereof, are provided. The apparatus for discharging the PDP with the time-lag includes a signal processor for separating a vertical synchronous signal of a horizontal line from a received video signal and delaying the vertical synchronous signal of the horizontal line in order to delay the discharge time of a next horizontal line, a data controller for generating a discharge pulse for discharging pixels of the horizontal line according to the vertical synchronous signal, and a discharge pulse for discharging pixels of the next horizontal line according to the delayed vertical synchronous signal, and a displayer for discharging the horizontal line and the next horizontal line by the discharge pulses with the time-lag and displaying the horizontal lines. According to the present invention, it is possible to use a large screen at home since it is possible to reduce instantaneous power consumption by discharging the PDP with the time-lag by the horizontal line.

6 Claims, 3 Drawing Sheets

APPARATUS FOR DISCHARGING PLASMA DISPLAY PANEL WITH TIME-LAG AND METHOD THEREOF

BACKGROUND OF THE INVENTION

1. Field of the Invention

The present invention relates generally to a plasma display panel (PDP), and more particularly, to an apparatus and method thereof for discharging a PDP display with a time-lag thereby reducing the instantaneous power consumption.

2. Description of the Related Art

Plasma displays have emerged as one of the dominant flat-panel display technologies. PDPs used for personal computers have proven to be small, light, and highly efficient. The term PDP refers to an electronic display device in which neon light emitted by applying a voltage between positive and negative electrodes while a gas such as Ne+Ar or Ne+Xe is filled in a hermetically sealed space between a front glass and rear glass partition. PDP displays have been successfully used over a very wide range of products. For example, PDPs have been used for factory automation (FA), ticket vending machines, and as an oil gauge in a gas station.

FIG. 1 shows the structure of the sub field and the television field of a plasma display panel.

Each of the pixels comprising an image should be discharged in order to display the image on the PDP. Conventional PDP displays simultaneously discharge all of the pixels comprising the display. High power on the order of 200 W (in the case of a 42 inch screen) should be applied to the panel in order to simultaneously discharge all of the pixels.

In accordance with conventional technology, one field of a television screen includes eight sub fields in order to show the brightness of an image displayed on the screen. As shown in FIG. 1, one sub field is comprised of a blank period, an erase period, an address period, and a sustain period. The respective pixels which constitute the screen display are simultaneously discharged, thus consuming significant power during the sustain period in which an image is substantially displayed on the PDP.

SUMMARY OF THE INVENTION

It is therefore an object of the present invention to provide an apparatus and associated method for discharging pixels in a plasma display panel (PDP) with a time-lag by dividing the horizontal lines of the PDP into two or more parts and discharging each part with a time lag therebetween, thus reducing the instantaneous power consumption.

Accordingly, to achieve the above object, there is provided an apparatus according to the invention for discharging a plasma display panel with a time-lag based on a horizontal line division, the apparatus includes a signal processor for separating a vertical synchronous signal of a first horizontal line from a received video signal and delaying the separated synchronous signal of the first horizontal line in order to delay the discharge time of a next horizontal line, a data controller for generating a discharge pulse for discharging pixels of the first horizontal line according to the vertical synchronous signal, and a discharge pulse for discharging pixels of a second horizontal line responsive to the delayed vertical synchronous signal, and a displayer for discharging the first horizontal line and the second horizontal line by the respective discharge pulses with a time-lag defined by the delayed vertical synchronous signal and displaying the horizontal lines.

To achieve the above-described object, according to the present invention, there is provided a method for discharging a plasma display panel with a time-lag of a first horizontal line relative to a second horizontal line, including the steps of (a) determining whether to discharge pixels in the first horizontal line and (b) determining whether to discharge pixels in a second horizontal line the moment the pixels of the first horizontal line are discharged according to the determination in step (a), wherein pixels of a horizontal line to be discharged are determined and then pixels of a next horizontal line to be discharged are determined the moment the pixels of the horizontal line are discharged.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

Hereinafter, the present invention will be described in detail with reference to the attached drawings.

Figure 1:
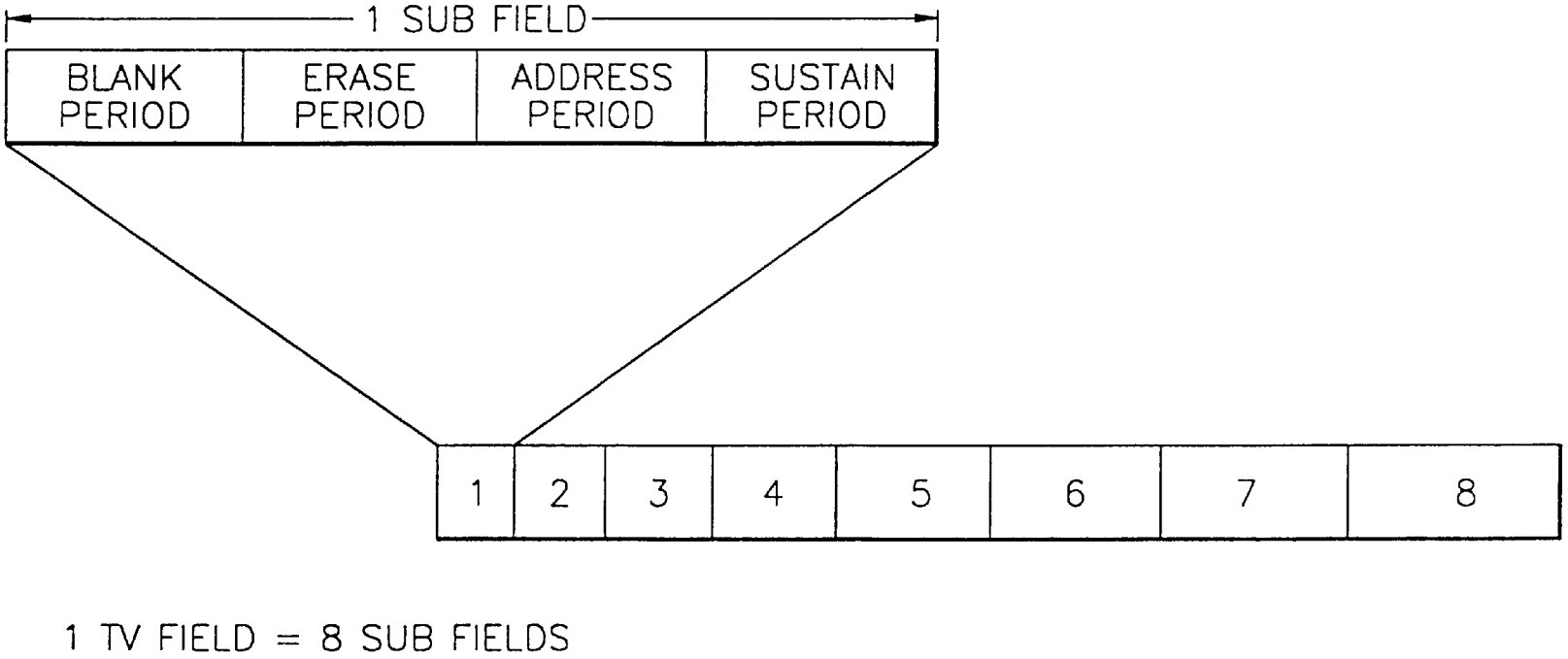
FIG. 1 (PRIOR ART)
FIG. 1 shows a conventional structure of a sub field and a TV field of a plasma display panel (PDP)
Figure 2:
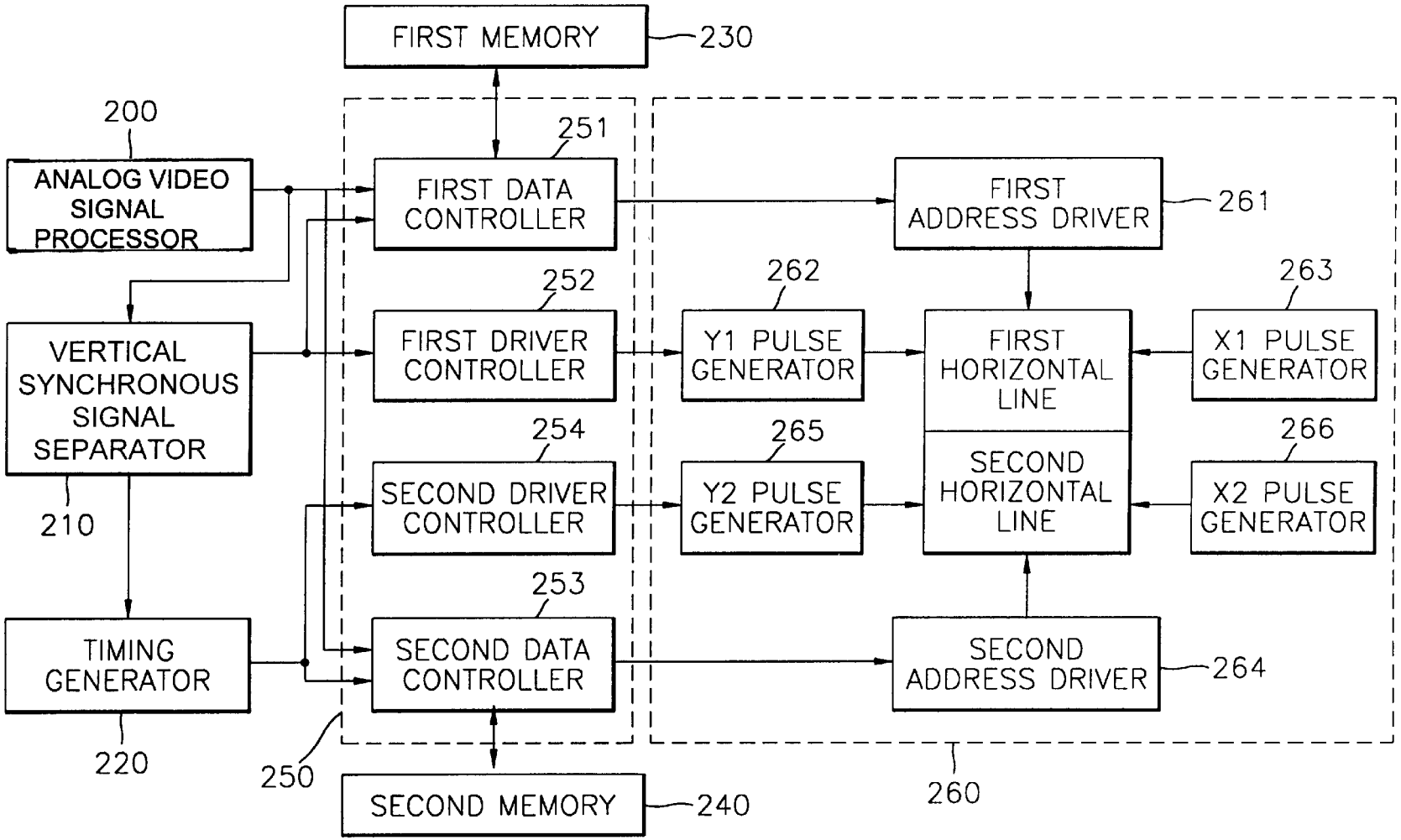
FIG. 2 is a block diagram showing the structure of an apparatus for discharging the PDP with a time-lag according to an embodiment of the present invention.

FIG. 2 is a block diagram showing the structure of an apparatus for discharging a PDP with a time-lag according to the present invention.

The apparatus shown in FIG. 2 includes a video signal processor 200 for converting a received analog video signal into a digital video signal and outputting digital video signals according to the respective horizontal lines, a vertical synchronous signal separator 210 for separating the vertical synchronous signal of a first horizontal line from the digital video data output from the video signal processor 200, a timing generator 220 for delaying the separated vertical synchronous signal of the first horizontal line for a predetermined time corresponding to a discharge time during the sustain period of a second horizontal line, and first and second memories 230 and 240 in which digital video data is stored according to the scanning method used. The apparatus also includes a controller 250 for determining whether the digital video data stored in the first memory 230 is to be discharged according to the vertical synchronous signal of the first horizontal line separated by the vertical synchronous signal separator 210, generating a discharge pulse for discharging the digital video data determined to be discharged, determining whether the digital video data stored in the second memory 240 is to be discharged according to the vertical synchronous signal of the second horizontal line delayed by the timing generator 220 for a predetermined time, and generating a discharge pulse for discharging the digital video data. The apparatus further includes a displayer 260 for displaying the first horizontal line and then the second horizontal line by discharging the first horizontal line and then discharging the second horizontal line after a delay for a predetermined time, according to the discharge pulses generated by the controller 250.

In the present invention, the controller 250 includes a first data controller 251 for receiving the digital video signal of the first horizontal line output from the video signal processor 200, and determining whether to discharge pixels based on the data stored in the first memory 230 according to the vertical synchronous signal of the first horizontal line output from the vertical synchronous signal separator 210, a first driver controller 252 for receiving the vertical synchronous signal of the first horizontal line output from the vertical synchronous signal separator 210, and generating switching data, i.e. data for creating a high voltage discharge pulse, for creating the discharge pulse. The controller 250 also includes a second data controller 253 for receiving the digital video signal of the second horizontal line output from the video signal processor 200, and determining whether to discharge pixels based on the data stored in the second memory 240 according to the vertical synchronous signal of the second horizontal line output from the timing generator 220, and a second driver 254 for receiving the vertical synchronous signal of the second horizontal line output from the timing generator 220, and generating switching data for creating the discharge pulse.

The displayer 260 includes a first address driver 261 for addressing pixels to be discharged in the first horizontal line determined by the first data controller 251, Y1 and X1 pulse generators 262 and 263 for applying the discharge pulse to the pixels to be discharged in the first horizontal line, a second address driver 264 for addressing pixels to be discharged determined by the second data controller 253 the moment the pixels of the first horizontal line are discharged by the Y1 and X1 pulse generators 262 and 263, and Y2 and X2 pulse generators 265 and 266 for applying the discharge pulse to the pixels to be discharged in the second horizontal line.

Hereinafter, the present invention will be described in detail with reference to FIG. 2.

The video signal processor 200 converts the received analog video signal into a digital video signal and outputs a digital video signal for each horizontal line. The vertical synchronous signal separator 210 separates the vertical synchronous signal for a first horizontal line from the digital video signal output from the video signal processor 200.

The timing generator 220 delays the separated vertical synchronous signal of the first horizontal line for a predetermined time in order to delay the discharge time during the sustain period of the second horizontal line. In one sub field of the PDP, an erase period is about 140 FS. A blank period is much smaller than the erase period. A sustain period is about 700 FS at its maximum. Therefore, since an address period is about 1.7 ms, it is possible to adjust the discharge time of the second horizontal line within the address period of the separated first horizontal line, and thus to realize the discharge with a time-lag. Namely, it is possible to create a delayed vertical synchronous signal which is the basis of the second horizontal line by delaying the vertical synchronous signal of the first horizontal line for a predetermined time.

The digital video data output from the video signal processor 200 is stored in the first and second memories 230 and 240 according to the scanning method used. The scanning methods include a progressive method and an interlace method.

The first data controller 251 determines when to discharge the pixels of the first horizontal line output from the video signal processor 200, based on the vertical synchronous signal of the first horizontal line output from the vertical synchronous signal separator 210 and the scanning method. For example, in the case of a three-electrode method of an AC-type PDP, wall charges are previously formed in pixels to be discharged and the pixels are discharged by the pulses generated by the Y1 and X1 pulse generators 262 and 263. At this time, the first data controller 251 determines whether to discharge the respective pixels.

The first driver controller 252 generates switching data for creating a high voltage discharge pulse for discharging the pixels, receiving the vertical synchronous signal of the first horizontal line output from the vertical synchronous signal separator 210.

The second data controller 253 determines whether to discharge the pixels of the second horizontal line output from the video signal processor 200, based on the vertical synchronous signal of the second horizontal line output from the timing generator 220 and the scanning method.

The second driver controller 254 generates switching data for creating the discharge pulse for discharging the pixels, receiving the vertical synchronous signal of the second horizontal line output from the timing generator 220.

The first address driver 261 prepares the pixels to be discharged on the first horizontal line on a screen, which are selected by the first data controller 251. Such an operation is performed during the address period in one sub field of the PDP.

The Y1 and X1 pulse generators 262 and 263 apply the high voltage discharge pulses to the pixels to be discharged of the first horizontal line arranged on the screen by the first address driver 261. Such an operation is performed during the sustain period in one sub field of the PDP. The high voltage discharge pulses of the Y1 and X1 pulse generators 262 and 263 are applied to the pixels to be discharged in the first horizontal line. Accordingly, the pixels are discharged.

The second address driver 264 prepares the pixels to be discharged on the second horizontal line, which are selected by the second data controller 253. Such an operation is performed during the address period of the second horizontal line the moment the pixels of the first horizontal line are discharged during the sustain period in one sub field of the PDP.

The Y2 and X2 pulse generators 265 and 266 apply the discharge pulses to the pixels to be discharged on the second horizontal line arranged on the screen by the second address driver 264. Such an operation is performed during the sustain period in one sub field of the PDP. The discharge pulses of the Y2 and X2 pulse generators 265 and 266 are applied to the pixels to be discharged in the second horizontal line. Accordingly, the pixels are discharged.

To further illustrate the present invention, an exemplary case will be described where the PDP is divided into a first horizontal line and a second horizontal line. However, the PDP can be further subdivided, for example, into a first horizontal line, a second horizontal line, and a third horizontal line. In this case when the second horizontal line is discharged, pixels to be discharged are arranged on a screen in the third horizontal line.

Figure 3:
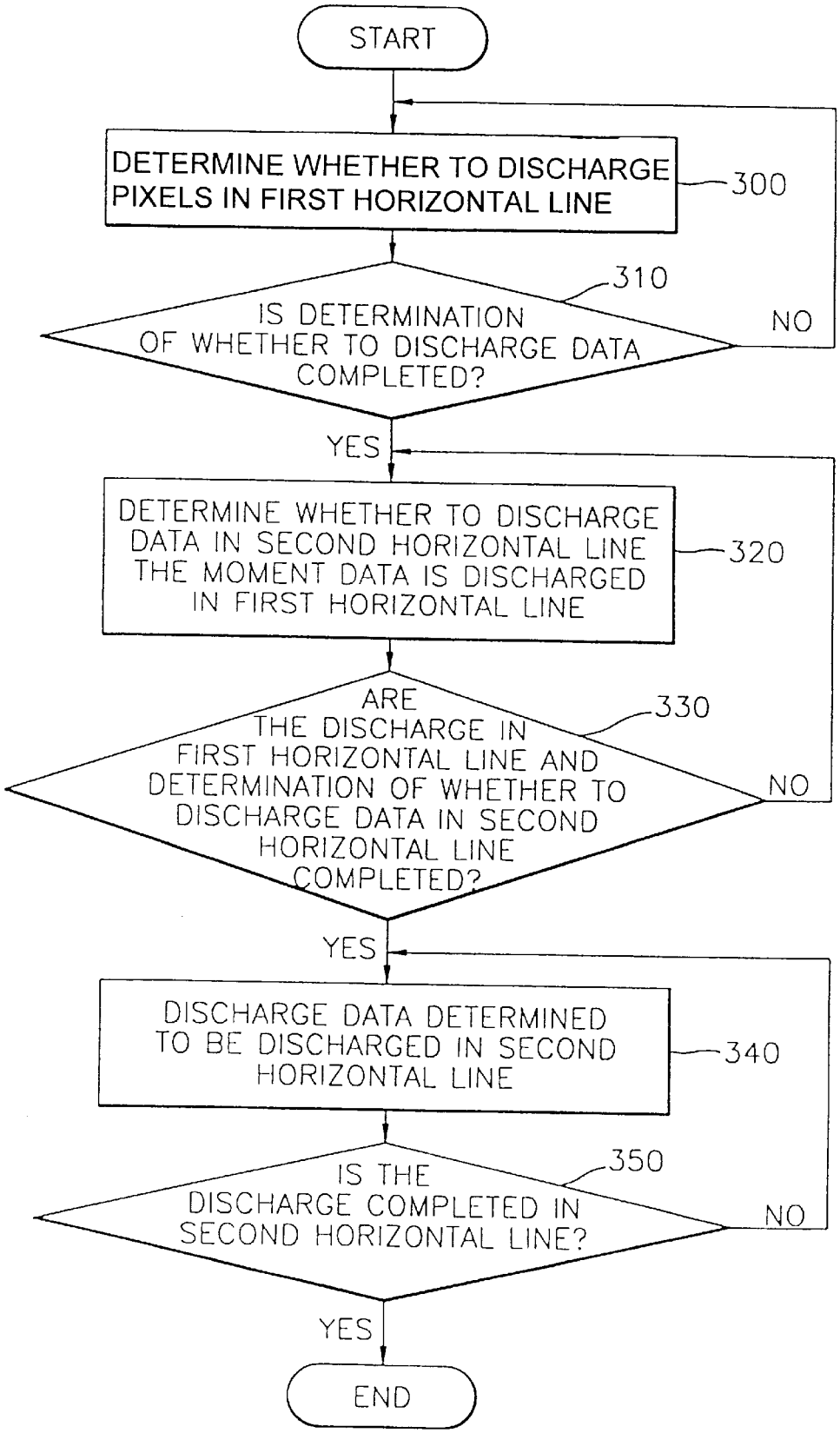
FIG. 3 is a flowchart illustrating the method of a preferred embodiment of the method for discharging the PDP with the time-lag according to the present invention.

FIG. 3 is a flowchart illustrating an embodiment of the method for discharging the PDP with a time-lag according to the present invention.

The method of the present invention described in FIG. 3 includes the steps of determining whether to discharge the pixels comprising the first horizontal line at step 300. Next, at step 310, a determination is made as to whether the discharge of pixels in the first horizontal line is complete, it is then determined, at step 320, whether to discharge pixels of the second horizontal line the moment the pixels in the first horizontal line are discharged at step 320, determining whether the discharge of the pixels in the first horizontal line is complete and also whether the determination of whether to discharge the pixels is complete in the second horizontal line at step 330, discharging the pixels determined to be discharged in the second horizontal line at step 340, and determining whether the discharge of the pixels is complete in the second horizontal line (step 350).

Hereinafter, the present invention will now be described in detail with reference to FIG. 3.

First, it is determined whether to discharge the pixels in the first horizontal line at step 300. This operation is performed during the address period in one sub field.

It is then determined whether the discharge the pixels in the first horizontal line is complete at step 310. If the discharge of pixels is not complete, the process returns to step 300.

When the discharge of pixels is complete, it is then determined whether to discharge the pixels in the second horizontal line the moment the pixels selected to be discharged in the first horizontal line are discharged at step 320, which is performed during the sustain period for the first horizontal line.

It is then determined, at step 330, whether the discharge of pixels in the second horizontal line is complete the moment the pixels are discharged in the first horizontal line.

If complete, the pixels determined to be discharged in the second horizontal line are discharged at step 340, otherwise the process returns to the step 320.

It is then determined whether the discharge of the pixels in the second horizontal line is complete at step 350. If not complete, the process returns to step 340, otherwise, the process is terminated.

In summary, it is possible to reduce instantaneous power consumption by discharging the pixels with the time-lag. The present invention facilitates the use of a large screen at home since it is possible to reduce instantaneous power consumption by dividing the PDP by the horizontal lines and discharging the PDP with the time-lag by horizontal line.

The present invention is not restricted to the above embodiments, and it is clearly understood that many variations are possible within the scope and spirit of the present invention by anyone skilled in the art.

What is claimed is:

1. An apparatus for discharging a plasma display panel with a time-lag, comprising:

a signal processor for separating a vertical synchronous signal of a horizontal line from a received video signal and delaying the vertical synchronous signal of the horizontal line to delay the discharge time of a next horizontal line;

a data controller for generating a first discharge pulse for discharging pixels of a first horizontal line according to the vertical synchronous signal, and a second discharge pulse for discharging pixels of a next horizontal line according to the delayed vertical synchronous signal; and a displayer for discharging the first horizontal line by said first discharge pulse and the next horizontal line by the second discharge pulse with the time-lag and displaying the first and second horizontal lines.

2. An apparatus for discharging a plasma display panel with a time-lag, comprising:

a vertical synchronous signal separator for separating the vertical synchronous signal of a first horizontal line from a received video signal;

a delay for delaying the vertical synchronous signal of the first horizontal line for a predetermined time in order to delay the discharge time of a second horizontal line;

a controller for determining whether to discharge pixels of the first horizontal line and for generating a discharge pulse for discharging the pixels of the first horizontal line determined to be discharged according to the vertical synchronous signal, and determining whether to discharge pixels of the second horizontal line and generating a discharge pulse for discharging the pixels determined to be discharged according to the delayed vertical synchronous signal; and a displayer for discharging pixels of the first horizontal line and the second horizontal line by the discharge pulses and displaying the first and second horizontal lines with the time-lag.

3. The apparatus of claim 2, wherein the delay delays the second horizontal line for a period of time from the discharge of the first horizontal line is discharged and the second horizontal line determines whether to discharge the pixels when the first horizontal line is discharged.

4. The apparatus of claim 2, wherein the controller comprises:

a first data controller for determining whether to discharge pixels of the first horizontal line based on the vertical synchronous signal of the first horizontal line and a scanning method;

a first driver controller for receiving the vertical synchronous signal of the first horizontal line, and for generating a pulse for discharging the pixels of the first horizontal line in response to said received vertical synchronous signal;

a second data controller for determining whether to discharge pixels of the second horizontal line based on the vertical synchronous signal of the second horizontal line and the scanning method; and a second driver controller for receiving the vertical synchronous signal of the second horizontal line, and for generating a pulse for discharging the pixels of the second horizontal line.

5. The apparatus of claim 2, wherein the displayer comprises:

a first address driver for addressing pixels to be discharged in the first horizontal line, said pixels being determined by the first data controller;

a first pulse generator for applying a discharge pulse to the pixels to be discharged in the first horizontal line;

a second address driver for addressing screen pixels to be discharged in the second horizontal line, said pixels being determined by the second data controller when the pixels of the first horizontal line are discharged by the first pulse generator; and a second pulse generator for applying a discharge pulse to the pixels to be discharged in the second horizontal line.

6. A method for discharging a plasma display panel with a time-lag, comprising the steps of:

(a) determining whether to discharge pixels in a first horizontal line; and (b) determining whether to discharge pixels in a second horizontal line when the pixels of the first horizontal line are discharged according to the determination in step (a), wherein pixels of a horizontal line to be discharged are determined and then pixels of a next horizontal line to be discharged are determined the moment the pixels of the horizontal line are discharged.

* * * * *